United States Patent [19]

Bock

[11] 3,946,847

[45] Mar. 30, 1976

[54] GOLF BALL VENDOR

[75] Inventor: Oscar Bock, Madison, Wis.

[73] Assignee: Bock Corporation, Madison, Wis.

[22] Filed: Nov. 4, 1974

[21] Appl. No.: 520,775

[52] U.S. Cl. ..... 194/57; 221/93; 221/200; 221/251; 221/266

[51] Int. Cl.[2] ..... G07F 11/00

[58] Field of Search ..... 221/93–95, 221/123, 133, 131, 200, 202–205, 263–266, 277, 296, 251, 298, 224; 194/54–58; 222/200, 223, 233, 247, 248

[56] References Cited

UNITED STATES PATENTS

| | | | |
|---|---|---|---|
| 408,959 | 8/1889 | Doubleday | 194/58 |
| 640,112 | 12/1899 | Dennis | 221/266 |
| 1,398,351 | 11/1921 | Williams | 221/266 |
| 1,600,158 | 9/1926 | Williams | 194/58 |
| 1,758,390 | 5/1930 | Curtis | 194/58 |
| 2,479,878 | 8/1949 | Steelzoff | 221/266 |
| 2,675,237 | 4/1954 | Willcox | 221/296 |
| 3,248,008 | 4/1966 | Mietjohan | 221/277 |
| 3,743,135 | 7/1973 | Brumley | 221/205 |

*Primary Examiner*—Robert B. Reeves
*Assistant Examiner*—H. Grant Skaggs
*Attorney, Agent, or Firm*—Theodore J. Long; John M. Winter; Harry C. Engstrom

[57] ABSTRACT

A coin-controlled, manually operable golf ball vending machine. The vending machine has a ball hopper and a ramp below the hopper defining a ball dispensing opening between them. A gate rotatably mounted at the opening, extends partially thereacross in its closed position to cause the balls to bridge the opening and is swung into the mass of balls to break up the bridging of balls for releasing them down the ramp when the actuating lever is pulled. The balls on the ramp are received in descending ballways for introduction into ball tubes formed in a rotatable cylinder extending across the bottom of the ballways. The actuating lever is operatively linked to both the gate and the cylindrical ball receiver for simultaneously rotating the gate to release balls down the ramp and the ball receiver for dumping balls therefrom. The actuating lever is maintained inoperative by a coin-releasable locking mechanism.

6 Claims, 10 Drawing Figures

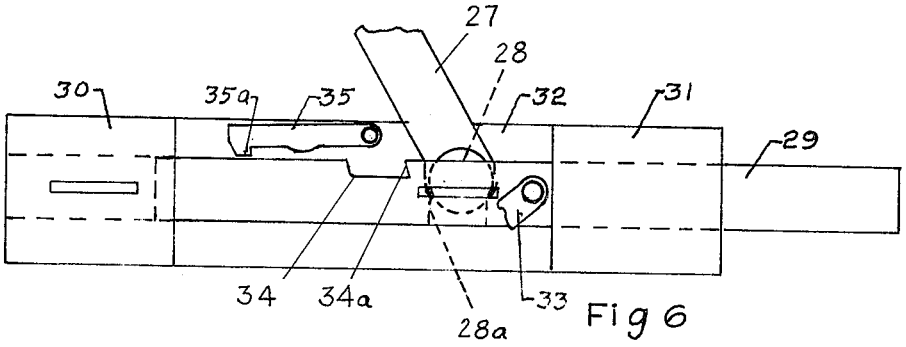
Fig 6
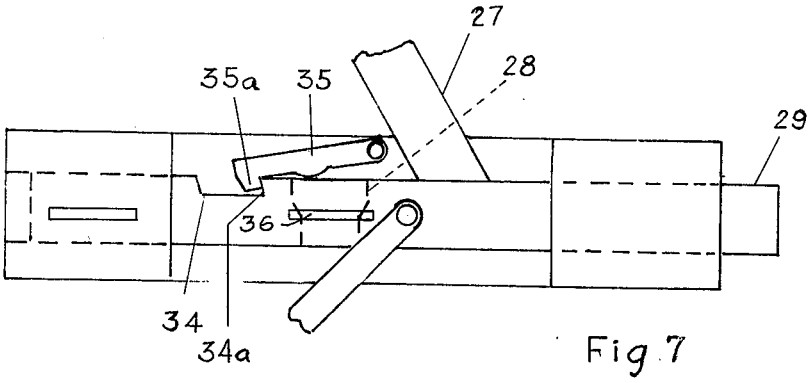
Fig 7
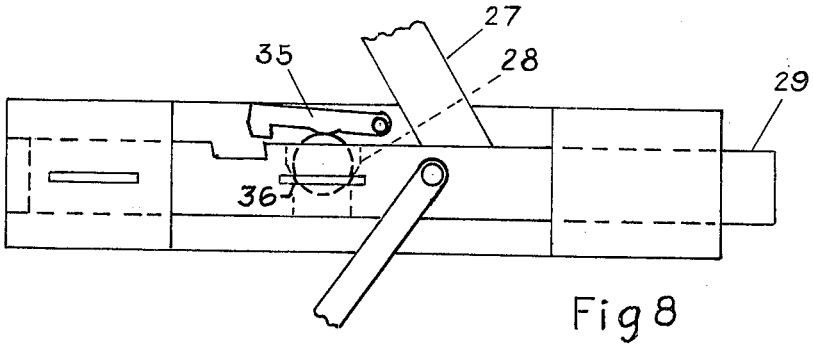
Fig 8
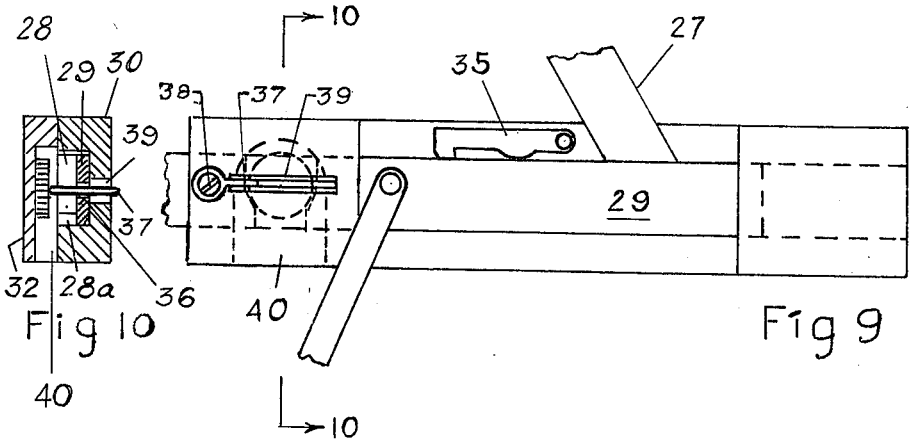
Fig 10
Fig 9

GOLF BALL VENDOR

BACKGROUND OF THE INVENTION

This invention relates to machines for dispensing a predetermined number of spherical articles from a hopper and more particularly to the golf ball vending machine.

DESCRIPTION OF THE PRIOR ART

Presently, the most widespread manner of dispensing golf balls for practice at golf courses and driving ranges is for an individual in the pro shop or office to rent a "bucket" of golf balls to the golfer by handing same to the golfer in exchange for payment. Although widespread, this is recognized from both the owner's and the customer's point of view as a somewhat bothersome and inefficient way of handling the matter.

Various golf ball vending machines are known such as for example that shown in U.S. Pat. No. 2,702,336 wherein a plurality of elongate ball tubes are individually manually filled with a predetermined number of balls and then placed in a coin-controlled machine from which each column of balls is then dispensed.

Another known golf ball vendor is an electrically driven machine in which a single pocket in a large diameter cylinder is loaded with a mass of balls as it passes under a hopper and is then dumped. A separate roller mechanism is provided to kick the overflow of balls out of the ball pocket to prevent binding of the machine.

Other machines for handling and dispensing various spherical articles are known such as shown in U.S. Pat. Nos. 2,429,510 and 2,479,878.

SUMMARY OF THE INVENTION

I have invented a new and improved golf ball vending machine which is coin-controlled and manually operated by the customer which faithfully dispenses a predetermined number of balls from a large hopper in a simple and efficient manner. My vendor which comprises only mechanical systems is simple, compact, and wheel portable so that it can be stored in the evenings to prevent vandalism and moved about to any location where it is needed.

The vendor has a large ball hopper with a ramp extending below the hopper to define a ball dispensing opening. A combination gate and "bridge buster" is positioned at the opening which causes balls to bridge across the opening in its closed position and breaks up the bridging as it is swung into the mass of balls for releasing balls down the ramp to the plurality of vertical ballways each accommodating a file or column of balls. An elongate generally cylindrical ball receiver having ball tubes formed therein extends across the bottom of the ballways for receiving a predetermined number of balls therefrom. The balls in the receiver are dumped into an outlet pan when a customer inserts a coin and pulls the operating lever forward. The movement of the operating lever simultaneously rotates the gate to maintain a full supply of balls in the vertical ballways and consequently in the ball tubes of the rotatable dumping cylinder. A window is provided through which the customer can see that the ball tubes are filled before inserting his coin.

Further objects, features and advantages of my golf ball vendor will be apparent from the following detailed description taken in conjunction with the accompanying drawings showing a preferred embodiment of my invention for exemplification.

BRIEF DESCRIPTION OF THE DRAWINGS

FIG. 6 is a side elevation view of the coin-releasable locking mechanism in its coin receiving position, with portions thereof shown in phantom.

FIG. 7 is a side elevation view of the coin-releasable locking mechanism of FIG. 6 shown in its locked position.

FIG. 8 is a side elevation view of the locking mechanism being released by a coin.

FIG. 9 is a side elevation view of the locking mechanism in its coin releasing position.

FIG. 10 is a sectional view taken along line 10—10 of FIG. 9.

DESCRIPTION OF A PREFERRED EMBODIMENT

Figure 1:
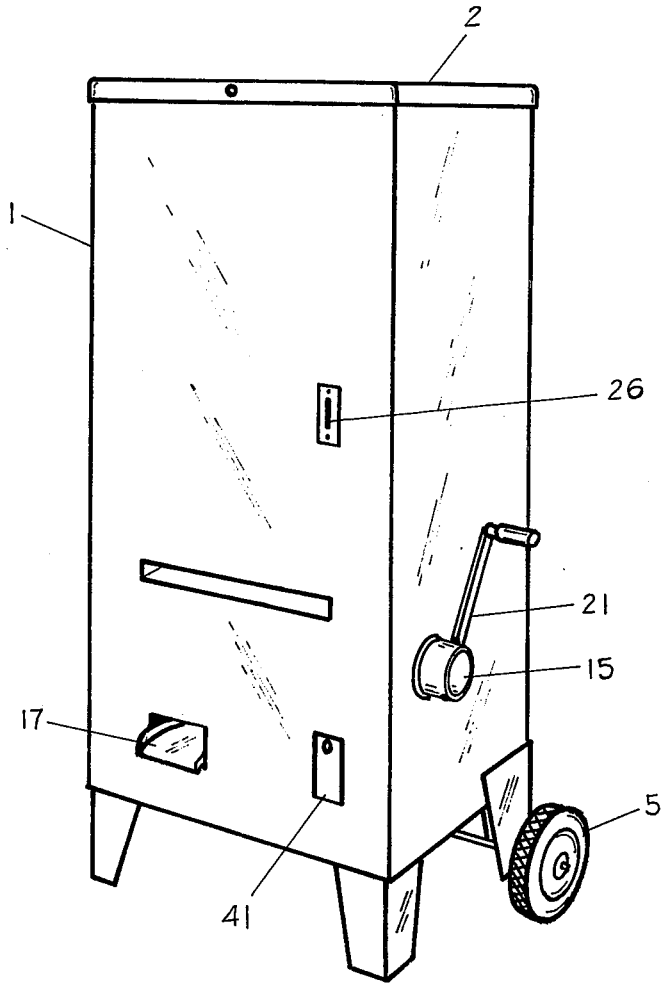
FIG. 1 is a perspective view of the front and one side of a ball vendor constructed in accordance with the present invention.

Referring now more particularly to the drawings wherein like numerals refer to like parts throughout the several views, my golf ball vendor is generally shown in FIG. 1.

Figure 2:
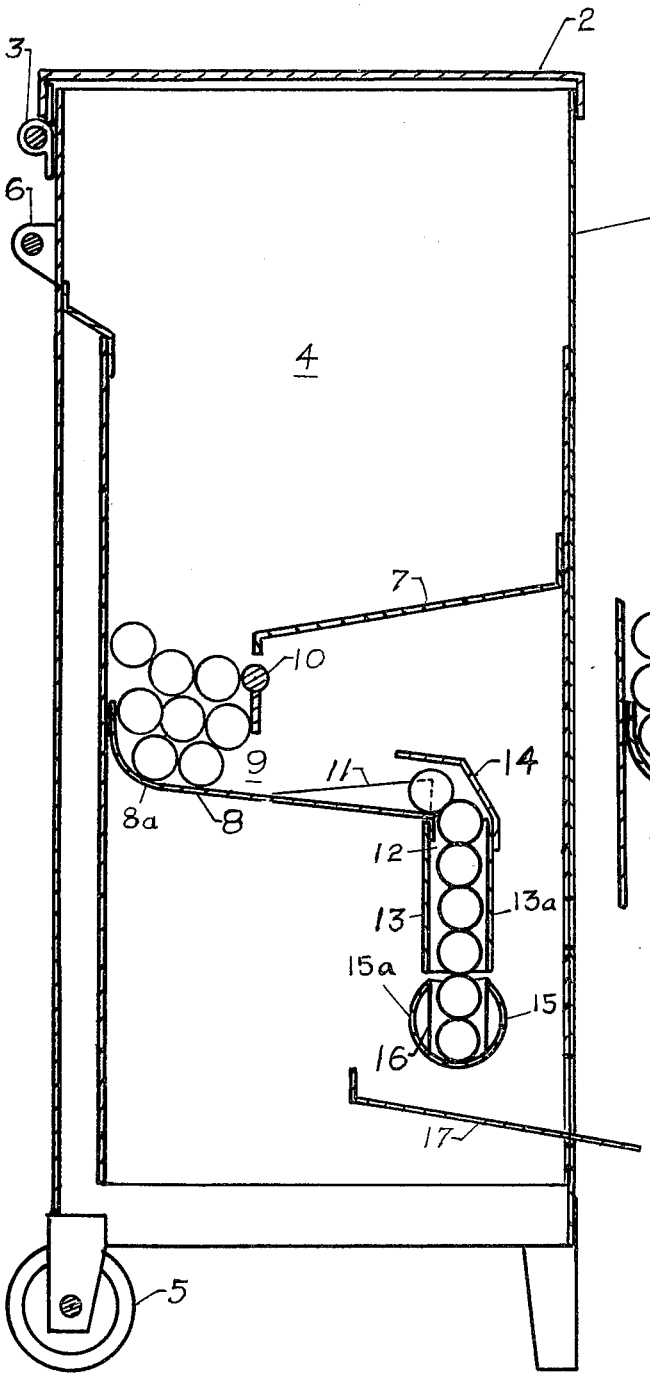
FIG. 2 is a schematic section view showing the ball path through a golf ball vendor with the ball cylinder in its ball receiving position.

Referring to FIGS. 1 and 2 the vendor has a cabinet 1 with a top cover 2 hinged at 3 for access to the ball hopper 4. The vendor is wheel supported at 5 and has a handle bar 6 for tipping the vendor rearwardly to facilitate moving.

The ball hopper 4 is tapered and has a rearwardly declining bottom pan 7. A forwardly declining ramp 8 extends below the pan 7 in spaced relation so as to provide a ball dispensing opening 9 therebetween.

Figure 3:
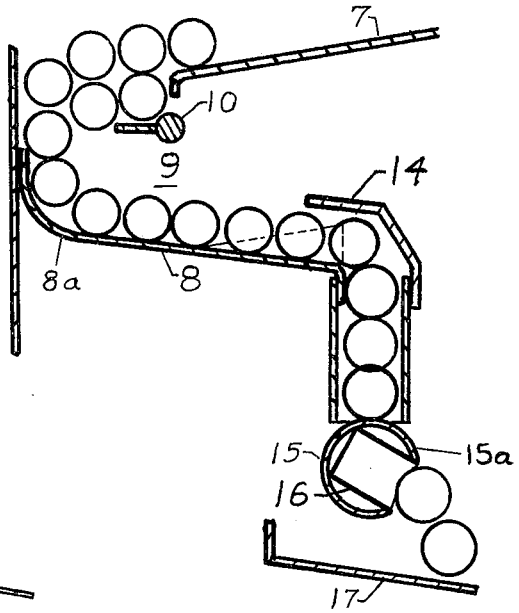
FIG. 3 is a broken-out schematic section view showing the ball path through the vendor with the ball cylinder in its dumping position.
Figure 4:
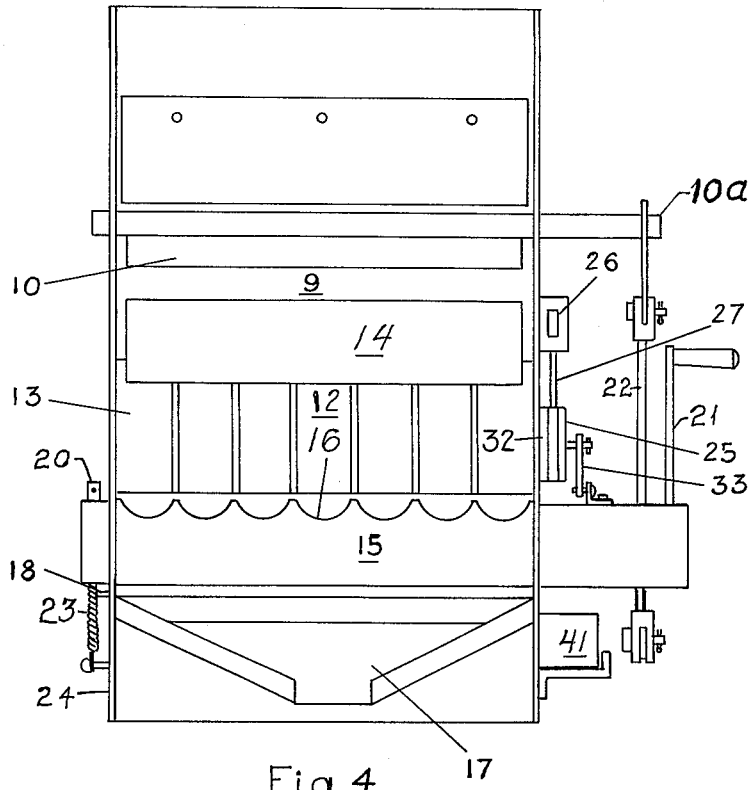
FIG. 4 is a front elevation view of the vendor of FIG. 1 with the cabinet removed to show the working mechanisms.

A gate 10 is rotatably mounted across the ball opening 9 as shown in FIGS. 2–4. As best seen in FIG. 2, the gate, in its closed position, extends downwardly to a point more than a diameter of one ball but less than the diameter of two balls from the ramp 8 which causes the balls to bridge the opening and thereby stop and flow of balls therethrough. The gate is pivotable about 90° into the mass of balls in the hopper to a release position shown in FIG. 3 to break up the bridged mass of balls at the opening and to loosen the mass of balls throughout the hopper to maintain flow as desired. The ramp is preferably curved as shown in 8*a* to facilitate the slightly backward and upward movement of the balls therealong as the gate is swung rearwardly to the ball release position.

Balls released through the dispensing opening 9 roll down the ramp 8 which has a plurality of dividers, one of which is shown at 11, for separating the balls into a plurality of single file rows prior to stacking in a number of chutes or ballways 12 formed by a storage unit 13. Seven ballways are shown in FIG. 4 from which the front plate 13a shown in FIG. 2 has been removed. A guard plate 14 stops any balls which might come flying through the opening 9 at a time when the empty hopper is first being filled.

As shown in FIGS. 2–4, a rotatably journalled, generally cylindrical ball receiver 15 extends across the lower ends of the descending ballways 12. The ball receiver cylinder has a plurality of ball tubes 16 equal in number to the number of ballways (seven shown). The tubes shown are each two balls deep so that the cylinder 15 will hold and dispense fourteen balls at a time. Each of tubes 16 is aligned under a corresponding ballway for receiving two balls from the ballway when the cylinder 15 is in the ball receiving position shown in FIGS. 2 and 4.

The rear surface 15a of the ball receiver cylinder 15 rotatably trails the ball tubes across the lower end of the ballways to maintain the stacks of balls therein as the cylinder is rotated forwardly about 115° to dumping position depicted in FIG. 3. In this position the balls in the tubes 16 spill onto the delivery pan 17 for exit from the vendor. The rotation of the cylinder is stopped by a pin 18 which abuts flange 20 on the cylinder.

Figure 5:
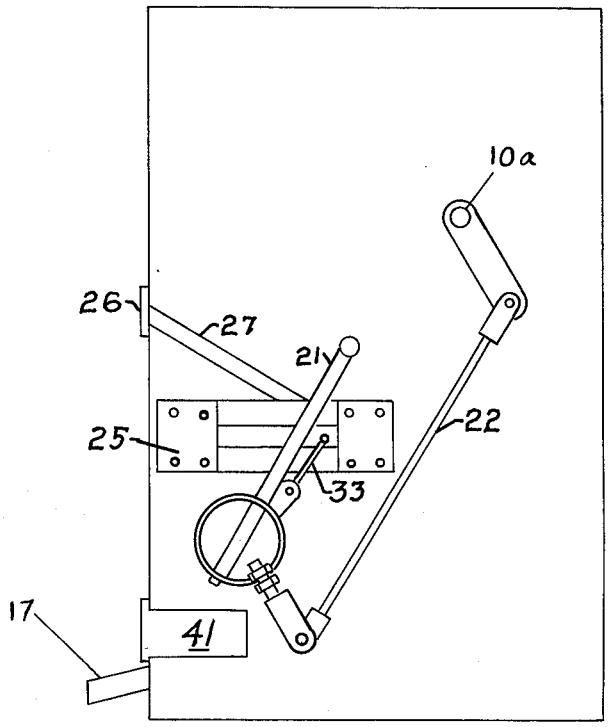
FIG. 5 is a right side elevation view of that portion of the golf ball vendor shown in FIG. 4.

Referring now to FIGS. 4 and 5, the vendor is operated by a manually movable actuating lever 21 which extends through the end of the ball receiving cylinder. The cylinder 15 is also connected by adjustable mechanical linkage shown at 22 to the protruding journal bar 10*a* of the gate 10. The actuating lever is pivotable forwardly about 115° so that the ball tubes extend downwardly about 25° from the horizontal as shown in FIG. 3. The gate 10 is simultaneously rotated about 90° from its closed position to its release position through linkage 22. A return spring 23 is attached to flange 20 and anchored to housing 24 for returning the cylinder to its ball receiving position and the gate to its closed position when the handle is released.

Referring to FIGS. 4–10, the vendor is coin-controlled in that it has a coin-releasable locking mechanism shown generally at 25 in FIG. 5. The vendor has a forwardly open coin slot 26 and a rearwardly declining coin chute 27 for carrying a coin of predetermined denomination to a coin pocket 28 formed in the inner face of a slide bar 29. The coin pocket has a narrower portion 28*a* extending downwardly through the slide bar through which coins smaller than the predetermined denomination fall from the coin pocket so as not to permit actuation of the vendor. The slide bar is mounted for rectilinear movement by a pair of mounting plates 30 and 31 and a backing plate 32. The ball receiving cylinder 15 has adjustable linkage shown at 33 connecting it to the slide bar for moving the slide bar sequentially from a coin receiving position shown in FIG. 6, to a locking position shown in FIG. 7, to a coin release position shown in FIG. 9 and return. A notch 34 is formed in the upper edge of the slide bar and provides a shoulder 34*a*. A gravity drop latch 35 has a hook portion 35*a* for dropping into the notch and engaging said shoulder when the slide bar is moved from its coin receiving position, FIG. 6, into locking position when no coin is present in the coin pocket of the slide bar as depicted in FIG. 7. When a coin of the predetermined size is present in the coin pocket as shown in FIG. 8, the coin engages the drop latch and prevents the hooked portion thereof from dropping into the notch thus permitting the slide bar to move through the locking position into said coin release position and permitting the ball receiving cylinder 15 to thus be rotated into its dumping position.

A slot 36 is formed through the side of the slide bar 29 into the coin pocket 28. A wire spring 37 attached by a screw 38 extends through a slot 39 formed in mounting plate 30 and through slot 36 when slot 36 is in register with slot 39 when the slide bar reaches its coin release position shown in FIG. 9. The spring pushes the coin out of the coin pocket, as shown in FIG. 10 into a release chute 40 formed in back plate 32 and when the slide bar begins its return movement, the coin is disengaged by the spring and drops by gravity into a coin box 41 shown in FIGS. 4 and 5.

It is understood that my invention is not confined to a particular construction and arrangement of parts herein illustrated and described, but embraces all such modified forms as come within the scope of the following claims.

I claim:

1. A golf ball vendor comprising:

a. a ball hopper having a bottom pan;

b. a declining ramp extending below said hopper bottom pan in spaced relation thereto, said pan and ramp defining a ball dispensing opening therebetween;

c. a gate pivotably mounted below said hopper bottom pan and above said discharge ramp at said opening rotatable between (1) a downwardly extending closed position wherein the lower edge of said gate is spaced more than the diameter of one ball and less than the diameter of two balls from said ramp to cause said balls in said hopper to bridge across said opening and (2) a release position into which said gate is swung toward the mass of balls in said hopper to break up the bridging of the balls therein for releasing balls down said ramp;

d. means providing a plurality of descending ballways each accommodating a single file roll of balls;

e. rotatably mounted ball receiver extending across the lower ends of said descending ballways for receiving a predetermined number of balls from said ballways; and f. manually movable actuating means operatively linked to said ball receiver and said gate for rotating said ball receiver for dumping balls therefrom and for rotating said gate from said closed position to said release position.

2. The golf ball vendor as specified in claim 1 wherein said ball receiver comprises:

a. a plurality of ball tubes equal in number to said plurality of ballways, one each of said ball tubes being aligned under a corresponding ballway for receiving balls from said ballways when said ball receiver is in ball receiving position; and b. a surface on said ball receiver rotatably trailing said ball tubes across the lower end of said ballways to maintain the balls therein as said ball receiver is rotated to dumping position.

3. The golf ball vendor as specified in claim 1 wherein said means providing a plurality of descending ballways comprises:

a. a plurality of dividers on said ramp providing a series of ball channels each accommodating a single file row of balls; and b. a plurality of substantially upright ball chutes at the end of said ramp for receiving balls from the channels of said ramp.

4. The golf ball vendor as specified in claim 1 having a coin-releasable locking mechanism for preventing operation of said manually movable actuating means.

5. The golf ball vendor as specified in claim 4 wherein said coin-releasable locking mechanism comprises:

a. a slide bar mounted for rectilinear movement sequentially from a coin receiving position, to a locking position, to a coin releasing position, and return; said slide bar having (1) a coin pocket formed therein for receiving a coin of predetermined size through the top thereof, said coin pocket having a narrower portion extending downwardly through said slide bar through which coins smaller than said predetermined size fall from said pocket and (2) a notch formed in the upper edge of said slide bar providing a shoulder on said slide bar;

c. a gravity drop latch having a hook portion for dropping into said notch and engaging said shoulder when said slide bar is moved from said coin receiving position to said locking position in the absence of a coin in the coin pocket of said slide bar, when a coin of the predetermined size is present in said coin pocket as said slide bar is moved from said coin receiving position toward said locking position said coin engages said drop latch and prevents the hook portion thereof from dropping into said notch permitting said slide bar to move through said locking position to said coin releasing position; and d. means linked to said manually movable actuating means for sliding said slide bar from said coin receiving position to said locking position before said ball receiver reaches its ball dumping position when no coin is present in the coin pocket of said slide bar.

6. The golf ball vendor as specified in claim 5 having:

a. a slot formed through the side of said slide bar into said coin pocket, and b. a spring disposed to extend through said slot for pushing a coin out of said pocket as said slide bar reaches said coin releasing position, said spring disengaging said coin when said slide bar is returned toward its coin receiving position whereby said coin drops by gravity.

* * * * *